United States Patent [19]

Bouvaist

[11] 3,988,180

[45] Oct. 26, 1976

[54] METHOD FOR INCREASING THE MECHANICAL FEATURES AND THE RESISTANCE AGAINST CORROSION UNDER TENSION OF HEAT-TREATED ALUMINUM ALLOYS

[75] Inventor: Jean Marie Amedee Bouvaist, Grenoble, France

[73] Assignee: Societe de Vente de l'Aluminium Pechiney, Paris, France

[22] Filed: Dec. 23, 1974

[21] Appl. No.: 535,740

[30] Foreign Application Priority Data

Jan. 7, 1974 France ..... 74.00399

[52] U.S. Cl. ..... 148/159; 148/12.7 A; 148/32.5

[51] Int. Cl.[2] ..... C22F 1/04

[58] Field of Search ..... 148/12.7, 11.5 A, 159, 148/32, 32.5, 2

[56] References Cited

UNITED STATES PATENTS

| | | | |
|---|---|---|---|
| 3,791,876 | 2/1974 | Kroger | 148/12.7 |
| 3,791,880 | 2/1974 | Hunsicker et al. | 148/12.7 |
| 3,826,688 | 7/1974 | Levy | 148/12.7 |

*Primary Examiner*—R. Dean

*Attorney, Agent, or Firm*—McDougall, Hersh & Scott

[57] ABSTRACT

The invention relates to a method of heat treatment which is applied to forged aluminum alloys, whereby the mechanical characteristics and resistance against corrosion under tension are increased considerably. This method is characterized by heating prior to tempering, above the temperature of eutectic melting, while remaining below the temperature of the start of the melting at equilibrium. The liquid phase formed temporarily is resorbed progressively, while the formation of pores is avoided by a sufficiently low hydrogen content of the metal. The application of this procedure to several aluminum alloys made it possible to observe increases of the limit of elasticity and of the break load of the order of 7% and a non-rupture stress under tension in 30 days at least equal to 30 hb.

6 Claims, No Drawings

METHOD FOR INCREASING THE MECHANICAL FEATURES AND THE RESISTANCE AGAINST CORROSION UNDER TENSION OF HEAT-TREATED ALUMINUM ALLOYS

The needs of the industry and particularly those of the aeronautical industry led the metallurgists to the creation of families of aluminum alloys by heat treatment with increasing performances. The first of these alloys was A-U4G (shade 2017 according to ASTM standard), which goes back to World War I.

Subsequently, at the same time as new alloys were discovered, the compositions of the oldest alloys were frequently improved and heat treatments capable of reinforcing the mechanical features were developed. The latter, variable according to the families or shades, still include the following three essential phases:

1. Placing elements in solution in solid condition of the alloy by heating to a suitable temperature.

2. Rapid cooling, for example by soaking in water, which makes it possible to maintain the solid solution at ambient temperature.

3. Final aging treatment at ambient temperature (aging) or at a suitably selected higher temperature (annealing), causing the fine precipitation of one or more phases rich in alloy elements, bringing about a considerable hardening of the alloy, usually called structural hardening.

The first phase of placing in solution in solid state generally is preceded by one or more operations of hot and/or cold transformation from the starting operation, generally obtained by a casting process.

Supplementary operations, such as a cold hammering, may also be carried out after the hardening and moreover, the aging may be performed in several stages at different temperatures. However, in all cases, the basic process is the same and comprises the combination of placing in solution, followed by hardening and then by aging.

All things being equal, the mechanical features of an alloy so treated are higher the larger the quantities of alloy elements which have been placed in solid solution. Since the solubility in solid state of the alloy elements increases with the temperature, an elevation of the solution treatment temperature brings about an enrichment of the solid solution of alloy elements, at least as long as compounds likely to be dissolved remain. This enrichment brings about, after hardening and annealing, an increase in the quantity of hardening precipitates and thus an increase in the mechanical characteristics. However, a limit exists as to this way of acting.

Thus, it has been recognized generally, by the person skilled in the art, that this temperature of placing in solution must always be below the temperature at which the metal commences to melt. In fact, it is recognized that this start of melting causes an irreversible degradation of the mechanical properties. In French, this phenomenon is commonly called "burning" and "eutectic melting" in the Anglo-Saxon countries, that is melting of the eutectics. Thus, for example, the Manual which is authoritative, called "Metals Handbook" 8th edition, volume 2, published by The American Society for Metals, FIG. 2, page 272, extracted from the article "Heat Treating of Aluminum Alloys" - ASM - Committee on heat treating of Al Alloys, shows the microstructure of an aluminum alloy panel, shade 2024 in state $T_4$ (according to ASTM standard) in which a slight superheating during the placement in solution has caused the phenomenon of "eutectic melting" characterized here by the presence of "rosettes" and melted granule joints. This phenomenon of burning or of eutectic melting occurs at a temperature we shall hereinafter call $T_o$. This temperature $T_o$ is always below or equal to the temperature $T_1$ when melting begins of the same alloy under the conditions of thermodynamic equilibrium. It is connected with the presence of metastable eutectics which formed during the processing and which still are present at the time of treatment of placing in solution.

Table I below, extracted from the manual already cited (page 271) shows the temperatures $T_o$ of melting of the eutectics for various alloys of series 2000, also the temperatures to be used for the placement in solution.

TABLE I

| Types of alloys | Temperatures of placement in solution | | Eutectic Melting Temperatures | |
|---|---|---|---|---|
| | ° F | Equivalence in ° C | ° F | Equivalence in ° C |
| 2014 | 925–945 | 496–507 | 950 | 510 |
| 2017 | 925–945 | 496–507 | 955 | 512 |
| 2024 | 910–930 | 488–499 | 935 | 502 |

This manual defines, according to the same criteria (page 272), the temperatures for the placement in solution, to be used for the principal forged Al alloys. They are shown in Table II.

TABLE II

Temperatures for placement in solution of forged aluminum alloys according to Metals Handbook (8th edition, Volume 2, page 272)

| Types of Alloys | Temperatures for placement in solution | |
|---|---|---|
| | ° F | Equivalence in ° C |
| 2014 | 925–945 | 496–507 |
| 2017 | 925–945 | 496–507 |
| 2024 | 910–930 | 488–489 |
| 2117 | 925–950 | 496–510 |
| 2219 | 985–1005 | 529.5–540 |
| 2618 | 970–900 | 521–532 |
| 6053 | 960–980 | 518–529.5 |
| 6061 | 970–1000 | 521–538 |
| 6062 | 970–1000 | 521–538 |
| 6063 | 970–1000 | 521–538 |
| 6066 | 970–1000 | 521–538 |
| 7075 | 860–880 (1) | 460–471 |
| 7079 | 820–860 | 438–471 |

(1) the panels of 0.050" (1.27 mm) and below can be placed in solution between 910 and 930° F (488–489° C).

The present invention relates to an original method for increasing the mechanical features of aluminum alloy products forged by structural hardening, of which at least one of the contents in additional elements directly participating in the structural hardening, such as for example Cu, Mg, Si, Zn, Ag, Li, is at least sufficient to saturate, with this element or these elements, the solid solution at temperature $T_o$.

The alloys concerned by the invention may contain also one or several secondary elements such as Mn, Fe, Ni, Cr, Zr, Ti, usually found in aluminum alloys, without this list being limitative in any manner. These elements may retain, in stable combinations, part of the elements participating in the structural hardening and this must be taken into consideration in the calculation of the contents of the latter.

The products of aluminum alloys having structural hardness with increased mechanical characteristics, treated according to said method, constitute by themselves another object of the invention. The products of aluminum characterized by the fact that their microstructure is substantially free from rosettes and thick grain joints, which are described in the Metals Handbook (see reference page 2, lines 3 to 7), on page 272 in the caption of FIG. 2 and which are characterized by a metal containing liquid phase at the time of hardening constitute another objective of the invention. Finally, in the products which are the objectives of the invention, due to a placement in solution at a temperature equal to or higher than the temperature of eutectic melting $T_o$, the overall concentration of an alloy element in the phase or phases, resulting from hardening and annealing, is above the limit of solubility of this element at a temperature immediately below $T_o$, that is at a temperature just below the one at which a start of the melting of the metastable phases is observed.

Applicant indeed discovered, in a completely unexpected manner, that it is possible, by means of certain precautions hereinafter described, to obtain forged aluminum alloy products, with improved characteristics, due to an original heat treatment which substantially consists of bringing the temperature of placement in solution prior to hardening (a temperature which hereinafter will be designated by $T_t$) to a value at least equal to and preferably considerably higher than the temperature $T_o$, while it still remains below or at least equal to temperature $T_1$.

Applicant has discovered that a treatment of this kind, contrary to the established doctrine, makes it possible by using a higher temperature for placement in solution, to obtain improved mechanical characteristics, due to the increase of the solubility of one or several structural elements of said alloys which directly particulate in the hardening. During this treatment, a partial fusion is obtained, because the operation is carried out at temperature $T_t$, such as $T_o \leq T_t \leq T_1$ which is likely to be resorbed by a sufficiently extended stay at temperature $T_t$. The hardening of the product is effected only, so as not to change the mechanical properties, when the melted part is eliminated entirely or substantially entirely.

The possibility of treating above $T_o$ had not been recognized until now, due to irreversible degradations due to the partial melting which affect the structure and the mechanical properties; said degradation being discussed abundantly in the literature, and particularly in the above cited Manual.

Applicant has discovered, in fact, that it is possible to prevent these degradations, not only by effecting the hardening (as has been indicated in the preceding paragraph) only on a product where the melted part is eliminated completely or almost completely, but still by reducing the content in hydrogen, likely to be released in gaseous form during the treatment for the placement in solution, down to a value below 0.5 ppm, and preferably below 0.2 ppm and even 0.1 ppm.

Several methods known to the skilled in the art are capable of reducing the hydrogen contents to the above indicated levels; by way of example we shall mention the degasification in liquid state, or maintaining, prior to the placement in solution, at a temperature below $T_o$ under vacuum or under an inert gas atmosphere, or of dried air, with the absence of hydrogen or material likely to release hydrogen, this stay being carried out for a sufficiently long time, which is a function of the size of the parts to be treated, in order to bring the hydrogen content likely to be released in gaseous form, to the sought level.

Likewise, during the treatment of the placement in solution, the presence of hydrogen or of substances containing hydrogen, likely to penetrate the metal and to degrade it, must be prohibited. For example, the treatment may be carried out in a vacuum furnace or under argon or helium, or nitrogen atmosphere, or in dried air with a dew point of about −15° C, or even in suitably dehydrated melted salt bath.

By taking precautions as indicated above, the liquid phase formed at the start of the treatment of placement in solution is progressively resorbed, due to the diffusion of the addition elements of the liquid zones toward the adjacent and unsaturated solid zones, so that after a relatively short holding time, the alloy again becomes completely or almost entirely solid, without the substantial appearance of voids and pores.

Applicant has discovered that any aluminum alloys subjected to the invention and treated according to it, after aging, presents mechanical features that are clearly improved over those obtained with the same alloy subjected to a conventional treatment of placement in solution, hardening and aging, while still preserving an excellent ductility.

The temperature $T_o$ varies in wide ranges from one alloy to another. For a given alloy, it depends on the forging and on the heat treatments. Thus, it is possible, for very highly forged products, to manage to eliminate by diffusion in solid state all or part of the metastable eutectics, which are responsible for the phenomenon of partial fusion on less forged products. Then, on these highly forged products it is possible to use, without observing any partial fusion, temperatures for placement in solution, which are higher than the one at which this partial fusion would be observed on less forged products. Thus, it is possible, as shown in the note of Table II, to bring the temperature of the placement of alloy 7175 in solution, between 488° and 499° C when the thicknesses are equal to or lower than 1.27 mm.

Thus, in order to apply the method according to this invention, it is necessary to determine for each alloy or product, the temperature $T_o$ by methods well known to the person skilled in the art, such as the differential heat analysis (ATD), effected under conditions of rise in temperature, analogous to the ones of the treatment of placement in solution, as well as the temperature $T_1$ of commencing fusion under the conditions of thermodynamic equilibrium. This second temperature is close to the one where the aluminum matrix commences to melt in its entirety. Then it will be possible to fix the temperature $T_t$ of placement in solution which must range between the two temperatures thus determined.

Applicant furthermore discovered, in a completely surprising manner, that the embodiment of the method according to the invention permitted very considerable improvement in the resistance against corrosion under tension of aluminum base alloys under structural hardening.

For example, the alloys called A-U4SG according to the French AFNOR standard A 02001 or 2014, according to the designations of the U.S. Aluminum Association, are often used in aeronautical constructions. An average compound includes, for example, 4.20% copper, 0.75% silicon, 0.5% magnesium, 0.6% manganese, with slight possible variations around these values, the remainder being aluminum taken most frequently at a purity of 99.7% (quality called A 7 according to the above mentioned AFNOR standard).

These alloys offer high mechanical characteristics, for example: break load 45 hbar, limit of elasticity 39 hbar, elongation at break >5%, but unfortunately, they have a mediocre resistance against corrosion under tension.

The standard of the Technical Services of French Aeronautics AIR-9050C prescribes alternate cycles of immersionemersion, under stress, in the reagent A3, containing:

| | | |
|---|---|---|
| NaCl | 30 | grams per liter |
| $Na_2PO_4$ | 0.19 | grams per liter |
| $H_3BO_3$ | 1.25 | grams per liter |
| demineralized water | 1 | liter |
| pH adjusted to 8.1 by adding a solution saturated with $Na_2Co_3$. | | |

Under these conditions, the maximum stress for non-rupture in 60 days (6 NR-60) for test pieces sampled in the short width direction does not exceed 8 to 12 hbars, which in most cases is considered insufficient, and constitutes a limitation as to the use of these alloys. It is known, moreover, that it is possible to somewhat improve the resistance against corrosion under tension of the A-U4SG by effecting a prolonged annealing, but then the mechanical characteristics are reduced in an often unacceptable amount.

It is then possible to increase the content of these alloys in addition elements (copper, silicon, magnesium), because of their greater solubility above temperature $T_0$ to proceed with a holding at temperature $T_t$ for a time which may vary between 1/2 and 12 hours, by maintaining, of course, the hydrogen content at less than 0.5 ppm, preferably at less than 0.2 ppm, and even less than 0.1 ppm, then proceeding with a final super-annealing heat treatment. It is noted that the product thus obtained offers a remarkably increased resistance against corrosion in relation to the products known.

The following examples will make it possible to better understand the embodiment of the invention:

EXAMPLE 1

An alloy of type 2014 (A-U4SG) was prepared by semicontinuous casting in the form of a plate 200 mm thick. Its composition was as follows: Cu 4.7%, Si 0.84%, Mg 0.45%, Mn 0.68%, Fe 0.23%.

After homogenization of 24 hours at 480° C and conversion by hot rolling into a sheet 50 mm thick, the differential heat analysis (ATD) showed that the beginning fusion of the alloy was produced at $T_0 = 511°$ C. The rate of the rise in temperature, during the ATD test, was 120° C/hour, that is substantially equal to the one used in the treatments of placement in solution below: the fusion of equilibrium $T_1$ occurred at about 525° C.

In this example, the content of copper likely to be placed in solution is higher than its limit of solubility in solid state at temperature $T_0$, which is about 4.3%.

Samples in the size of 100 × 70 × 50 mm were taken from the plate. The first sample was placed in solution according to a conventional treatment for 4 hours at 505° C (that is 6° C below $T_0$), then immersed in water at 20° C. After 4 days at ambient temperature, it was subjected to an 8 hour annealing treatment at 175° C. The second sample was exposed to a treatment for placement in solution without special precaution at 520° C for 4 hours (that is 9° C below $T_0$), followed by tempering and annealing under the same conditions as before.

To better illustrate the interest of the invention, a third sample was exposed to a 24 hour treatment at 460° C under vacuum, followed by a placement in solution for 12 hours at 521° C (that is 10° C above $T_0$) in a furnace ventilated in an atmosphere of dried air. Tempering and annealing then were effected under the same conditions as above.

Test pieces for mechanical tests were taken in each one of the three samples treated, in the longitudinal direction and in the short width direction.

The results obtained are shown in Table III below:

TABLE III

Treatment 1: 4 hours at 505° C
Treatment 2: 4 hours at 520° C
Treatment 3: 24 hours at 460° C under vacuum + 12 hours at 521° C.

| Direction of test pieces | Treatment of placement in solution | Limit of Elasticity at 0.2% in hb | Break Load in hb | Break Elongation |
|---|---|---|---|---|
| Short width direction | 1 | 43.5 | 47.5 | 3.5% |
| | 2 | 46.0 | 47.8 | 1.3% |
| | 3 | 46.5 | 50.6 | 5.5% |
| Long direction | 1 | 45.2 | 50.3 | 11.3% |
| | 2 | 48.0 | 50.5 | 4.5% |
| | 3 | 48.6 | 52.9 | 8.2% |

It can be seen that treatment 3, which is the one according to the invention, makes it possible to increase the limit of elasticity and the break load by about 3 hb, that is an increase of 7% over the elastic limit in relation to the conventional treatment (1). From the viewpoint of elongation, an improvement of the isotropy is noted with a slight reduction of the break elongation in length but, on the contrary, with a clear increase of the break elongation in the thickness (short width) direction.

It is shown on the other hand that the treatment of placement in solution, carried out directly without special precaution at a temperature above the metastable fusion temperature $T_0$ (2), caused a fragilization of the tempered metal.

The dosage of hydrogen has been effected in each case: for treatments 1 and 2 the hydrogen content was approximately 0.3 ppm, for treatment 3 it was less than 0.1 ppm.

EXAMPLE 2

An experimental alloy type Al-Cu-Mg-Si, containing 2.15% copper, 0.78% Si, 0.80% Mg, 0.10% Cr, was prepared in the form of a plate 100 mm thick. After 24 hours homogenization at 500° C, a plate 2 mm thick was obtained by rolling. The temperature of commencing fusion $T_0$ measured by ATD was 537° C and the temperature of fusion at equilibrium $T_1$ was about 550° C. Such an alloy has contents in Si and Mg which exceed the limit of solubility in solid state at temperature $T_0$.

A first sample, taken from the panel, was subjected to a normal treatment, including a placement in solution for 30 minutes at 530° C, effected in a salt bath, followed by immersion in water at 20° C and annealing for 4 hours at 170° C.

A second sample was treated according to the invention in the following manner: degasification treatment for 8 hours at 450° C under vacuum, followed by treatment of placement in solution for 30 minutes at 545° C (8° C above $T_o$) in salt bath, then tempering and annealing under the same conditions as before. Then test pieces were taken from the samples for mechanical tests whose length corresponded with the rolling direction.

TABLE IV

| | Placement in solution | Elastic Limit at 0.2% in hb | Break Load in hb | A (%) |
|---|---|---|---|---|
| Standard treatment | 530° C | 28.7 | 40.4 | 24.2 |
| Treatment according to invention | 545° C | 30.6 | 43.0 | 27.4 |

It is seen that the treatment according to the invention allows, in this case, for an improvement of about 7% in the break load and the elastic limit against the standard treatment and also makes possible an increase in ductility.

EXAMPLE 3

An Al-Zn-Mg-Cu alloy shade X7050, according to the A.A. standard, was prepared in the form of a plate 300 mm thick and 750 mm wide. Its composition was as follows: Zn 6.2%, Mg 2.25%, Cu 2.40%, Fe 0.08%, Si 0.06%. Following a 24 hour treatment of homogenization at 460° C, the plate was converted into a sheet 55 mm thick. In this condition the temperature $T_o$ is 478° C. This alloy has copper and magnesium contents which exceed the limits of solubility in solid state at temperature $T_o$.

Parallelepiped samples of 10 × 10 × 55 mm were taken in the short width direction and treated in the following manner:

lot 1: normal treatment, that is: 4 hours at 476° C in a melted salt bath, immersion in water at 20° C, annealing in ventilated furnace 4 days after immersion, 4 hours at 120° C + 9 hours at 162° C.

lot 2: treatment according to the invention, namely: degasification under vacuum, 8 hours at 430° C + 4 hours at 488° C in salt bath (that is 10° C above temperature $T_o$).

The mechanical characteristics determined by traction test are shown in Table V below:

TABLE V

| | Elastic Limit at 0.2% in hb | Break Load in hb | Elongation at break (%) |
|---|---|---|---|
| Lot 1: Standard treatment (placement in solution at 476° C) | 53.8 | 58.4 | 4.0% |
| Lot 2: Treatment according to the invention (placement in solution at 488° C) | 55.6 | 60.3 | 6.1% |

Here again it is shown that the treatment according to the invention (lot 2) makes it possible considerably to increase the total of the mechanical traction characteristics.

The following example shows how the embodiment of the invention makes it possible to increase the resistance against corrosion under tension.

EXAMPLE 4

Two alloys of the AU4SG family were prepared, one with a composition modified by increasing the content in copper, magnesium and silicon, the other one was of the classical composition:

| | | | |
|---|---|---|---|
| Copper | = | 4.7% | |
| Magnesium | = | 0.6% | Alloy mark I, |
| Silicon | = | 0.85% | |
| Manganese | = | 0.6% | modified composition |
| Aluminum A7 | = | balance | |
| Copper | = | 4.41% | |
| Magnesium | = | 0.49% | Alloy mark II, |
| Silicon | = | 0.75% | |
| Manganese | = | 0.57% | conventional composition |
| Aluminum A7 | = | balance | |

Then by casting plates 120 mm thick were created from both alloys I and II, which were subjected to the following conversion cycles: one the conventional one, the other one according to the invention.

1. Conventional treatment:
   - conventional homogenization (rise to 490° C during 12 hours, holding 12 hours at 490° C), slow cooling in furnace).
   - cold hammering of 10 minutes per side.
   - hot rolling: heating to 440° C, reduction from 100 to 50 mm in 5 passes, temperature at end of rolling at 380°/390° C.
   - classical placement in solution, in air ventilated furnace (rise in 2 hours to 505° C, hold for 6 hours at 505° C, tempering in water).
   - cold hammering of test pieces in short width and long width directions.
2. Treatment according to the invention:
   - special homogenization in dry atmosphere at dew point.
   - −10°/−15° C under the following conditions:
     + rise in 10 hours to 515° C
     + holding for 2 hours at 515° C
     + cooling in 3 hours to 460° C.

Then the following procedures were applied:
   - cold hammering of 10 minutes per side
   - checking the hydrogen content (0.15 ppm)
   - hot rolling as above
   - a placement in special solution accoring to the principal invention at a temperature $T_t$ such as $T_o < T_t < T_1$; $T_1$ having been found to be equal to 516/518° C (by micrographic tests and differential heat analysis), $T_t$ max. was established with 513°/514° C. This treatment was operated on dry ventilated air, at a dew point ranging between −15° and −20° C, under the following conditions:

| | |
|---|---|
| + rise in 7 hours to 511° C | |
| + holding 2 hours at 511° C | +2° C |
| + tempering in water | −0° C |

Then

- cold hammering of 2% by traction
- sampling of test pieces in short width (TC) and long width (TL) direction.

After natural aging for 4 days in the atmosphere, after tempering, the test pieces were subjected to the following conventional treatment:

| | | |
|---|---|---|
| one part | + rise in 4 hours to 154° C | |
| | + holding 22 hours at 154° C | +2° C<br>−0° C |

the others, to a super-annealing treatment; 48 hours at 175° C; the 48 hour duration corresponding to an optimal duration of an interval of 24 to 72 hours.

The different test pieces were measured for resistance to corrosion under tension by alternate immersion-emersion cycles (10 minutes, 50 minutes) in the previously described reagent A5, at 20°/22° C. Previously, the test tubes were degreased with acetone, pickled by a fluonitric reagent, rinsed in distilled water and dried, also with a measurement of the mechanical characteristics (break load R, elastic limit $LE_{0.2}$ and elongation at break A %).

Table VI compiles the results of the different tests, showing how the resistance against corrosion under tension builds up and the mechanical characteristics of control alloy (II) and the alloy with a composition modified in function of the different parameters: conventional homogenization and special homogenization according to the principal invention, conventional annealing and annealing according to the invention.

It is noted in particular that the combination of the special homogenization and of the super annealing (column 6) carried out on the control alloy makes it possible to discover the resistance against corrosion under tension at a satisfactory level (non-breakage in 60 days under 16 hb and in 30 days under 24 to 28 hb), but at the cost of reduction in the mechanical characteristics. On the other hand, by combining the change of the alloy composition, the special homogenization and the super annealing, the mechanical features of the control alloy are found largely, under the conventional treatment with a non-rupture stress in 30 days equal to 24 to 28 hb, and in 60 days - 8 hb. The increases of characteristics are particularly valuable in aeronautic constructions due to the demands by the constructors and the extremely severe tests they impose on the alloys used.

Table VII shows the behavior under corrosion, under tension, of lots of 5 test pieces of classical and modified composition treated the conventional way and according to the invention, in function of the rate of stress.

The figures in each case indicate the service life of the test pieces prior to rupture and the number of them which did not break after 60 days.

TABLE VI

| | 1 | | 2 | | 3 | | 4 | | 5 | | 6 | | 7 | |
|---|---|---|---|---|---|---|---|---|---|---|---|---|---|---|
| Composition of the alloy | control (mark II) | | modified (mark I) | | control (mark II) | | control (mark II) | | modified (mark I) | | control (mark II) | | modified (mark I) | |
| Treatments: | | | | | | | | | | | | | | |
| Homogenization | conventional | | conventional | | special | | conventional | | special | | special | | special | |
| Annealing | conventional | | conventional | | conventional | | super-annealing | | conventional | | super-annealing | | super-annealing | |
| Mechanical Characteristics | TC | TL | TC | TL | TC | TL | TC | TL | TC | TL | TC | TL | TC | TL |
| R | 47.5 | 48.9 | 48.0 | 48.9 | 48.4 | 50.1 | 44.5 | 46.0 | 49.0 | 51.1 | 45.8 | 47.1 | 47.5 | 49.0 |
| Long Width LE | 41.6 | 43.2 | 42.7 | 44.6 | 43.2 | 45.2 | 38.8 | 40.5 | 45.3 | 47.0 | 39.6 | 40.7 | 43.0 | 44.0 |
| Short Width A% | 5.9 | 7.2 | 3.6 | 3.2 | 6.4 | 8.3 | 5.7 | 8.6 | 4.3 | 5.0 | 5.2 | 8.5 | 4.3 | 5.3 |
| Maximum stress for non-rupture in 30 days (in hb) | 8 to 12 | | 8 to 12 | | 8 to 12 | | 20 to 24 | | 18 to 22 | | 24 to 28 | | 30 | |

TABLE VII

| Alloy | Heat Treatment | Annealing | Rate of stress in hectobars - Lot of 5 test pieces | | | | | |
|---|---|---|---|---|---|---|---|---|
| | | | 8 | 12 | 16 | 20 | 24 | 28 |
| Mark II (control) | Special according to the invention | conventional 22h - 154° C | 5 > 60 days | 2.5 2.5 3 > 60 days | 1, 1, 1, 2.5 2.5 | — | — | — |
| | | super-annealed 48h - 175° C | 5 > 60 days | 5 > 60 days | 5 > α days | 34 47 3 > 60 days | 35, 45, 55 2 > 60 days | 35, 54, 55, 56 1 > 60 days |
| Mark I composition modified according to the invention | conventional | conventional 22h - 154° C | 5 > 60 days | 56 4 > 60 days | 1, 1, 1.5 1.5, 1.5 | — | — | — |
| | special according to the invention | conventional 22h - 154° C | 50 4 > 60 days | 1, 1.5, 3.7 2 > 60 days | 1, 1, 1.5, 1.5, 1.5 | — | — | — |
| | | 48h - 175° C | 5 > 60 days | 5 > 60 days | 5 > 60 days | 53 4 > 60 days | 46, 50 3 > 60 days | 46, 46 3 > 60 days |

I claim:

1. A process for improving the mechanical properties and resistance to stress corrosion of wrought heat treated aluminum alloys containing one or more hardening elements selected from the group consisting of Cu, Mg, Si, Zn, Ag and Li in which at least one of said elements is present in the alloy in an amount sufficient to at least saturate the solid solution at the eutectic melting temperature $T_o$, the amount in the alloy of hydrogen capable of being released in gaseous form, during the solution heat treatment being less than 0.1 ppm, in which process the alloy is subjected to a solution heat treatment, before quenching, at a temperature $T_t$ such that $T_o \leq T_t \leq T_1$ ($T_1$ being the incipient melting temperature under conditions of thermodynamic equilibrium) and over a period such that the metastable liquid phases initially formed are substantially completely resorbed, so that after a short holding time the alloy becomes solid, and quenching and aging said heat treated alloy.

2. A process as claimed in claim 1 in which the alloy contains in addition one or more secondary elements selected from the group consisting of Mn, Fe, Ni, Cr, Zr and Ti.

3. A wrought product of an aluminum alloy which has been heat treated by the process of claim 1.

4. A wrought product of an aluminum alloy which has been heat treated by the process of claim 2.

5. A wrought product of aluminum, as claimed in claim 4, in which the microstructure of the alloy is substantially free from rosettes and agglomeration of molten grains, and in which at least one secondary element is present in the phases resulting from quenching and aging in a total concentration exceeding the solubility limit of that element at a temperature immediately below the temperature $T_o$.

6. A process as claimed in claim 1 in which the heat treatment results in a micro structure that is substantially free of rosettes and wide grain boundaries.

* * * * *